US006204421B1

(12) United States Patent
Genssler et al.

(10) Patent No.: US 6,204,421 B1
(45) Date of Patent: Mar. 20, 2001

(54) METHOD OF DISPOSING OF WASTE IN A COKING PROCESS

(75) Inventors: Klaus Genssler, Houston; Raymond R. Ruth, Pearland, both of TX (US)

(73) Assignee: Scaltech Inc., Houston, TX (US)

( * ) Notice: Subject to any disclaimer, the term of this patent is extended or adjusted under 35 U.S.C. 154(b) by 0 days.

(21) Appl. No.: 09/185,394

(22) Filed: Nov. 3, 1998

(51) Int. Cl.[7] ..... C10G 1/00; C10G 33/00; C10B 55/02; C10B 57/02

(52) U.S. Cl. ..... 585/240; 208/50; 208/131; 208/187; 208/13; 201/2.5; 201/25

(58) Field of Search ..... 208/50, 131, 187, 208/13; 201/2.5, 25; 585/240

(56) References Cited

U.S. PATENT DOCUMENTS

| | | | | |
|---|---|---|---|---|
| 4,118,281 | | 10/1978 | Yan | 201/2.5 |
| 4,176,052 | | 11/1979 | Bruce et al. | 208/131 |
| 4,404,092 | | 9/1983 | Audeh et al. | 208/131 |
| 4,443,325 | | 4/1984 | Chen et al. | 208/55 |
| 4,547,284 | | 10/1985 | Sze et al. | 208/50 |
| 4,666,585 | | 5/1987 | Figgins et al. | 208/131 |
| 4,810,393 | * | 3/1989 | Guinard | 210/712 |
| 4,968,407 | | 11/1990 | McGrath et al. | 208/131 |
| 4,985,131 | | 1/1991 | Lane | 208/13 |
| 5,009,767 | | 4/1991 | Bartilucci et al. | 208/85 |
| 5,389,234 | | 2/1995 | Bhargava et al. | 208/131 |
| 5,439,489 | | 8/1995 | Scalliet et al. | 44/281 |
| 5,443,717 | | 8/1995 | Scalliet et al. | 208/131 |
| 5,788,721 | | 8/1998 | Scalliet et al. | 44/281 |

OTHER PUBLICATIONS

K. Miller, J. Gentry, W. Carter; Scaltech Coker Recycling; Presented to Equilon/Motiva; Sludge Coking Workshop; Oct. 22, 1998 (32 p.).

Scaltech Inc.; Proposal Submitted to Motive Enterprises LLC for ScalfuelK Preparation From Cuff, API Sludge, and Other Oil Bearing Refinery Residuals for Coker Recycling; Sep. 23, 1998; (28 p.).

* cited by examiner

*Primary Examiner*—Walter D. Griffin
*Assistant Examiner*—Thuan D. Dang
(74) *Attorney, Agent, or Firm*—Conley, Rose & Tayon P.C.

(57) ABSTRACT

A method for recycling a waste stream containing water and solids comprises (a) removing water from the waste stream to produce a second stream containing less than 60% by weight water, (b) drying the second stream to produce a waste feed charge containing less than 15% by weight water, and (c) injecting the waste feed charge into a coker during the coking cycle. The water removal can be carried out in one or more steps, and can be carried out in a vertical disk centrifuge if it is also desired to reduce the particle size of the solids fraction. The waste feed charge can be injected into a delayed coker, flexicoker, or fluid coker, and allows the recycle of solid waste into the coke.

33 Claims, 2 Drawing Sheets

METHOD OF DISPOSING OF WASTE IN A COKING PROCESS

FIELD OF THE INVENTION

The present invention relates to a process for recycling of waste, particularly petroleum waste, generated in refinery operations. More particularly, the present invention relates to the disposal and/or recycling of waste in a coking process.

BACKGROUND OF THE INVENTION

The Coking Process

Coking has been practiced for many years. The process involves the exposure of a feed stream to heat, resulting in thermal cracking of heavy liquid hydrocarbons in the stream to produce gas, liquid streams of various boiling ranges, and coke.

Various processes for the production of coke are known in the art. In a delayed coking process, a petroleum fraction is heated to coking temperatures and then fed into a coke drum under conditions that initiate thermal cracking. Following the cracking off of lighter constituents, polymerization of the aromatic structures occurs, depositing a porous coke mass in the drum.

In a typical delayed coking process, residual oil is heated by exchanging heat with the liquid products from the process and then fed into a fractionating tower where any light products that might remain in the residual oil are distilled out. The oil is then pumped through a furnace, where it is heated to the required coking temperature. From the furnace, the hot oil is discharged into the bottom of the coke drum. The oil undergoes thermal cracking and polymerization for an extended period, resulting in the production of hydrocarbon vapors and porous carbonaceous coke that remains in the drum. The vapors leave the top of the drum and are returned to the fractionation tower, where they are fractionated into the desired cuts. This process is continued until the drum is substantially full of porous coke. Residual oil feed is then typically switched to a second parallel drum, while steam is introduced through the bottom inlet of the first drum to quench the coke.

The steam strips out the remaining uncracked oil in the drum. During the early stage of steaming, the mixture of water and oil vapors continues to pass to product recovery, as during the coking stage. Thereafter, the effluent from steaming is diverted to blow-down facilities, where it is condensed and transferred to settling basins. In the settling basins, oil is skimmed from the surface of the water.

After steam cooling to about 700°–750° F., water is introduced to the bottom of the coke drum to complete the quench. The first portions of water are, of course, vaporized by the hot coke. The resultant steam plus oil vapor is passed to blow-down for condensation and skimming to separate oil. Water addition is continued until the drum is completely filled with water. For a period thereafter, water is introduced to overflow the drum with effluent sent to settling equipment for removal of entrained oil, etc.

The water settling system also receives water from other operations in the coker facility as later described. The clarified water produced by the settling system provides the water for quench and for recovery of coke from the drum. Coke recovery proceeds by removal of top and bottom heads from the drum and cutting of the coke by hydraulic jets. First, a vertical pilot hole is drilled through the mass of coke to provide a channel for coke discharge through the bottom opening. Then a hydraulic jet is directed against the upper surface of the coke at a distance from the central discharge bore, thereby cutting the coke into pieces. The pieces drop out of the coke drum through the pilot hole. The cutting jet traverses the drum until the coke bed is completely removed.

The coke leaving ranges in size from large lumps to fine particles. To a considerable extent, the fines are separated from the larger pieces as the coke discharges into slotted bins or hopper cars, with the water draining off through the slots. This dispersion of fines in water is processed to recover the fines as solid fuel, and the water returns to the system for use in quenching and cutting.

In a flexicoking process, a material stream circulates continuously between a reactor and a heater. More specifically, a feed stream is fed into a fluidized bed, along with a stream of hot recirculating material. From the reactor, a stream containing coke is circulated to a heater vessel, where it is heated. The hot coke stream is sent from the heater to a gasifier, where it reacts with air and steam. The gasifier product gas, referred to as coke gas, containing entrained coke particles, is returned to the heater and cooled by cold coke from the reactor to provide a portion of the reactor heat requirement. A return stream of coke sent from the gasifier to the heater provides the remainder of the heat requirement. Hot coke gas leaving the heater is used to generate high-pressure steam before being processed for cleanup. Coke is continuously removed from the reactor.

In a fluid coking process, a fluidized bed reactor is used in conjunction with a burner to provide continuous coke production. The feed stream is introduced into a scrubber, where it exchanges heat with the reactor overhead effluent and condenses the heaviest fraction of the hydrocarbons leaving the top of the reactor. The total reactor feed, including both the fresh feed and the recycle condensed in the scrubber, is injected into a bed of fluidized coke in the reactor. The coke is laid down on the fluidized coke particles, while the hydrocarbon vapors pass overhead into the scrubber. The reactor overhead is scrubbed for solids removal and the high boiling material is condensed and recycled to the reactor. The lighter hydrocarbons are sent from the scrubber to conventional fractionation, gas compression, and light ends recovery units.

Heat required to maintain the reactor at coking temperature is supplied by circulating coke between the reactor and the burner. A portion of the coke produced in the reactor is burned with air to satisfy the process heat requirements. The excess coke is withdrawn from the burner and sent to storage.

Sludge Disposal

Many refineries, chemical plants, waste water treatment plants and other such industrial and municipal facilities generate waste products in the course of their operation. For example, in the refining of petroleum there are produced waste products or streams such as heavy oil sludges, biological sludges from waste water treatment plants, activated sludges, gravity separator bottoms, storage tank bottoms, oil emulsion solids including slop oil emulsion solids and dissolved air flotation (DAF) float from flocculation separation processes, etc. The disposal of these waste products can create difficult and expensive environmental problems primarily because the waste streams are not readily amenable to conversion to more valuable, useful or ecologically innocuous products.

Several methods have been proposed for dealing with the disposal, in an economical and environmentally acceptable fashion, of waste products such as petroleum refinery sludges and other such waste products. One proposal for dealing with petroleum sludges is disclosed in U.S. Pat. No. 3,917,564, which discloses a process in which sludges and other wet by-products of industrial and municipal activities are added to a delayed coker as an aqueous quench medium during the quench portion of the delayed coking cycle. The combustible solid portions of the by-product become a part of the coke, and the non-combustible solids are distributed throughout the mass of the coke so that the increase in the ash content of the coke is within commercial specifications, especially for fuel grade coke products.

Another patent relating to disposal of refinery waste solids in a coker quench stream is U.S. Pat. No. 5,443,717, which discloses pretreating the sludge before injecting it into the main quench stream. More particularly, '717 patent discloses passing the waste stream (sludge) through a centrifuge, where it is separated into an oil stream, a water stream and a wet sediment stream. The wet sediment stream is in turn passed through a dewatering apparatus and the dewatered solids are then fed into the main quench stream of the coker.

Still another process is disclosed in U.S. Pat. No. 4,666,585, which discloses a process in which petroleum sludges are recycled by adding them to the feedstock of a delayed coker before the quenching cycle so that the sludge, together with the feed, is subjected to delayed coking. This process has the desirable aspect of subjecting the combustible portion of the sludge to the high coking temperatures so that either the conversion to coke or the distillation of residual hydrocarbon products takes place. The presence of water in the sludge tends to lower the temperature in the coker unless compensation is made for this factor, for example, by increasing the operating temperature of the coking furnace. This in turn may decrease the yield of the more desirable liquid product from the delayed coking process. In addition, because the sludge contains large amounts of water and oil, the amount of sludge that can be added to the coker feed is limited by the presence of the relatively large amount of water in the sludge. It has been calculated that for every ton of water that passes through the coker unit, coker production is reduced by approximately 4-½ tons of coker feed. Likewise, oil in the waste is unnecessary for a coker unit. It has been calculated that each ton of oil passing through the coker unit reduces the coker feed by approximately 1-½ tons. As described in the '585 patent, the amount of sludge in the stream is limited to a maximum of 2 weight percent.

Another proposal for dealing with petroleum sludges is disclosed in U.S. Pat. No. 4,874,505, in which oily sludges and other refinery waste streams are segregated into a high oil content waste that is injected into a delayed coking unit during the coking phase of the cycle and a high water content waste that is injected during the quenching phase of the delayed coking cycle. This process purportedly increases the capacity of the delayed coker to process refinery wastes and sludges and has the potential for improving the quality of the resulting coke obtained from the process. Using this process, refinery sludges can be added at a rate of up to about 2 bbl/ton of coke produced. The separation process adds an additional process step and neither stream is sufficiently tailored to avoid undesirably affecting the coker operation. For example, the water content of the stream entering the coker is disclosed to be 25%, again resulting in a severe reduction of coker efficiency. U.S. Pat. No. 5,009,767, discloses a process similar to the '505 patent, with the modification that the high oil content sludge is filtered to remove water prior to being introduced into the delayed coking unit during the coking phase of the cycle.

While the above processes are somewhat effective for disposing of waste products such as refinery sludges, in general they are not wholly satisfactory. For example, there is often a significant loss of valuable oil (organics), which is absorbed in the coke or collected in the blow-down system. With quench cycle injection of raw oil sludges, there is a tendency for oily build-up to occur in the coke drum, causing the volatile combustible matter (VCM) levels in the coke to be objectionably high. Likewise, when sludge is incorporated in the coker feedstock, both oil and water in the sludge adversely affect the efficiency of the system by reducing the production of coke.

Hence it is desirable to provide a method that allows addition of a refinery waste stream or sludge to the coking process without encountering the disadvantages heretofore associated with such additions. The present invention significantly minimizes the disadvantages of the prior art.

SUMMARY OF THE INVENTION

The present invention provides a method for adding a refinery waste stream or sludge to the feed stream of a coker without encountering the disadvantages heretofore associated with such additions. The present method entails removing sufficient water and oil from a stream initially containing water, oil and solids so that the remaining stream can be fed to a coker during the coking process without adversely affecting the efficiency of said process.

The present invention includes a method of producing a processed waste feed charge for recycle in a coker process. The waste feed charge is produced by passing the waste or sludge into a separation unit, such as a centrifuge, which separates the waste into an oil fraction, water fraction, and solids fraction. It is particularly preferred that the solids have a particle size less than 250 microns and preferably less than 75 microns to ensure that the solids do not settle out of the waste during transportation to the coker facility.

If the waste feed charge is produced at the coker facility and pumped directly into the coking process, the particulate size of the solids becomes less important since the waste stream may be agitated to keep the solids suspended in the slurry. However, should the waste feed charge be transported by tanker to the coking facility, it is preferred that the particulate size of the solids be less than 250 microns to avoid any settling prior to reaching the coker facility.

The solids fraction is sent to a mixer that emulsifies the waste and where oil may be added to ensure the pumpability of the waste feed charge. While the maximum pumpable viscosity depends on the equipment available, it is generally believed that compositions having viscosities greater than 5,000 cp. at greater than 150° F. are outside the pumpable range for typical pumping systems. The effluent from the mixer flows to a dryer where the water content of the waste feed charge is further reduced. Preferably the water content is reduced to less than 15% by weight and more preferably reduced to less than 3% by weight. If desired, the water content can be further reduced to substantially zero. It is necessary that the oil in the waste feed charge be at least 30% by weight to ensure that the waste feed charge is pumpable. It is more preferable that the solids and oil be approximately equal by weight.

In a delayed coking process, the fresh coker feed is fed into the bottom of the drum. The prepared waste feed charge is fed into the top of the coker during the coking cycle, preferably after an initial amount of coke has accumulated in the coker drum. In contrast, in a flexicoking process, the coke feed and waste feed charge may both be introduced into the top of the coker. During the coking process, the solids in the waste feed charge become dispersed in the produced coke to effectively recycle of the solids fraction of the waste.

The present invention allows refinery waste streams to be processed on-site so as to allow feed directly to an on-site coker. In an alternative embodiment, the present inventions provides a treated sludge that can be transported to a coker that is remote from the sludge generation site. While the present invention is discussed in detail below in terms of a delayed coking process, it will be understood that it can be used to equal advantage in flexicoking processes and the like.

BRIEF DESCRIPTION OF THE DRAWINGS

For an introduction to the detailed description of the preferred embodiments of the invention, reference will now be made to the accompanying drawings, wherein.

DETAILED DESCRIPTION OF THE PREFERRED EMBODIMENTS

While the process of the present invention will be described with particular emphasis toward treating of waste products produced in the refining of petroleum, it is to be understood that it is not so limited. For example, waste products derived from chemical processes, municipal sewage treatment plants and other such facilities that produce waste products, can be disposed of in a coking process according to the present invention. However, the process finds particular application in treating waste products produced during the refining of petroleum, as the process enables the recycling of solids in the waste products and the recycling of other components of the waste products into the refinery operation.

Waste Processing

Figure 1:
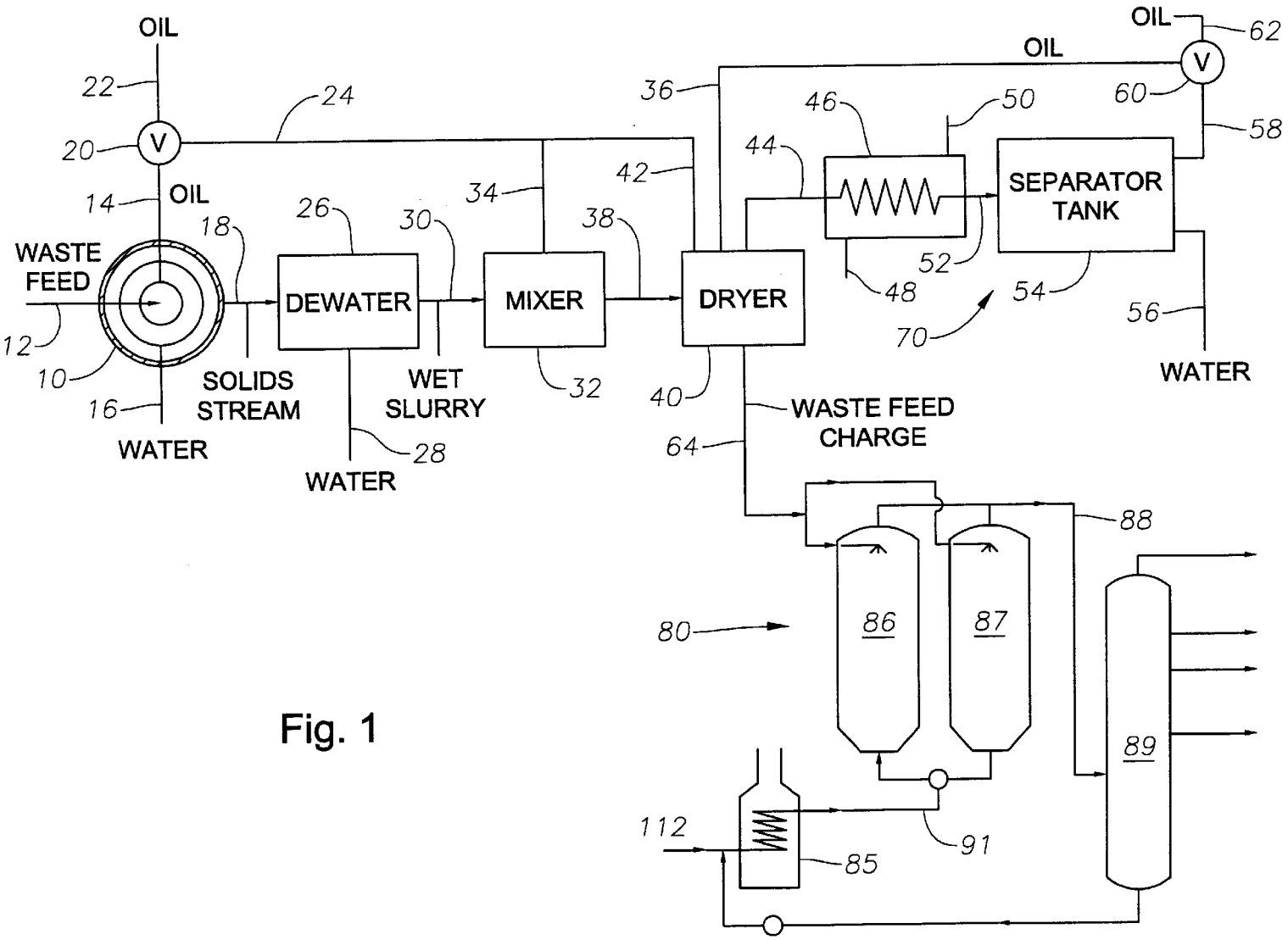
FIG. 1 is a schematic flow diagram of the process of the present invention.

Referring initially to FIG. 1, a preferred system for carrying out the present invention comprises a vertical disk centrifuge 10, mixing tank 32, a dryer 40, a liquid separation system 70 and a coking system 80. The centrifuge 10, mixer 32, and dryer 40 are used to prepare a waste feed charge for use in the coker process.

Vertical disk centrifuge 10 is preferably similar to the centrifuges disclosed in U.S. Pat. Nos. 4,810,393 and 4,931,176, both of which are incorporated herein by reference for all purposes. Vertical disk centrifuge 10 receives a waste (feed) stream from line 12. The centrifuge 10 separates the waste stream into an organic fraction (oil) that exits centrifuge 10 via line 14, an aqueous fraction (water) that exits centrifuge 10 via line 16 and a solids fraction (solids) that exits centrifuge 10 via line 18. The solids fraction is subsequently processed to become the feed charge for recycle in the coking system 80. The water removed via line 16 is substantially free of organic compounds and solids and can be recycled for further use in the refinery or, if desired, can be sent to a waste water treatment facility. The oil exiting line 14 passes through two-way valve 20, where it can be recycled via line 22 for further processing such as recycled to the refinery. Alternately, or in addition, and as will be seen hereafter, a portion of the oil can pass via valve 20 and line 24 for further use in the process of the present invention.

Generally speaking, the solids fraction or wet sediment leaving centrifuge 10 will comprise over 50%, and more typically at least 80%, by weight water, less than 15% by weight oil and the remainder solids. The water removed in de-watering apparatus 26 is sent via line 28 to disposal or for further use. Depending on the nature of the waste, it may be desirable to further reduce the water content of the wet sediment or solids fraction exiting centrifuge 10 via line 18 prior to further processing. In these instances, an additional de-watering apparatus 26 is included in the system.

De-watering apparatus 26 can be any apparatus for separating solids and liquids such as, for example, filtration equipment. Thus, the de-watering apparatus 26 can comprise a filter press, continuous vacuum filters such as drum filters, disk filters, horizontal filters such as table filters, pan filters and belt filters, belt presses, centrifugal separators, etc. De-watering apparatus 26 can also comprise a settling tank that allows the solids to concentrate in a thickened slurry that is removed as desired. In an alternative embodiment (not shown), de-watering apparatus 26 replaces the vertical disk centrifuge 10, in which case the de-watering apparatus 26 removes the bulk of the water and oil from the solids fraction. The solids fraction leaving dewatering apparatus 26 comprises 25–60 percent by weight solids, 5 to 75 percent by weight oil and 5 to 75 percent by weight water. By way of example, solids fraction leaving dewatering apparatus 26 may comprise 35 percent by weight solids, and about equal proportions of oil and water.

The solids fraction leaving centrifuge 10, (or de-watering apparatus 26) passes via line 30 into a mixing tank 32. Typically, the de-watered solids fraction removed from de-watering apparatus 26 will contain less than about 60% by weight water, and preferably less than about 50% by weight water, and will also contain from about 30 to about 45% by weight solids and from about 5 to about 20% by weight oil. In addition to the de-watered solids fraction, oil is also introduced into mixing tank 32 via line 34. The amount of oil added via line 34 is preferably sufficient to produce a 1:1 ratio of solids to oil and in any event sufficient to make the waste feed charge pumpable. In mixing tank 32, the waste feed charge is subjected to high shear so as to produce a generally homogeneous slurry or emulsion. All or a portion of the oil added to mixing tank 32, as will be seen hereafter, can be supplied via line 36 from oil recovered in subsequent processing of the de-watered solids.

The waste feed charge passes via line 38 into dryer 40. Dryer 40 is preferably a heat exchanger such as is described in detail in U.S. Pat. No. 5,439,489, which is incorporated herein by reference. As shown therein, dryer 40 is preferably designed to effect heat exchange heating of the waste feed charge. In addition, dryer 40 is provided with agitators that induce forced convection conditions to ensure that there is no settling of solids and to aid in efficient heating of the waste feed charge. Alternatively, dryer 40 can be any suitable dryer that is capable of removing water from the waste feed charge and includes equipment for recapturing low boiling hydrocarbons that evaporate during the drying process. These low boiling hydrocarbons can be recycled within the present system, or returned to the refining system. Also introduced into dryer 40 via lines 24, 42 is oil recovered from the oil fraction originally separated in centrifuge 10, thus producing a waste feed charge. The amount of oil added in mixing tank 32 and in dryer 40 is preferably controlled so as to ensure that the amount of oil in the waste feed charge ultimately produced will be from about 30 to about 70% by weight and more preferably be approximately equal to the amount of solids in the waste feed charge.

Preferably, the waste feed charge is introduced into dryer 40 at a rate that permits gentle to moderate flash vaporization of water so as to avoid any resultant carryover of solids out of dryer 40. In dryer 40, vaporization of the water plus volatile organic liquids is conducted at a temperature of from about 205° to about 300° F., the vaporized water and organic liquids passing out of dryer 40 via line 44 into condenser 46, cooling fluid being passed through condenser 46 via lines 48 and 50. The liquid condensed in condenser 46 passes via line 52 into separator tank 54, where gravity separation of the oil/water mixture takes place, the water being removed via line 56, the oil being taken via line 58 through valve 60 and either recycled or transferred via line 62 back for further processing, depending upon need, to dryer 40 via line 36.

The heat exchange heating of the waste feed charge in dryer 40 is continued until the water content of the waste feed charge is reduced to a desired level, i.e., until the waste feed charge contains less than about 15% by weight water and at least about 30% by weight of liquid including water and oil, the remainder being solids (generally from about 35 to about 70% by weight solids). If a lower water content is desired, drying continues until that water content is obtained. For example, it is preferable for the waste feed charge to have less than 5% by weight water, and more preferably less than 3% by weight water, with the remaining solids and oil being in approximately equal proportions. It is still further desirable for there to be substantially zero water in the waster feed charge, with the solids and oil comprising about 50% each. The water in the waster feed charge, with the solids and oil comprising about 50% each. The processed waste feed charge thus obtained is recovered from dryer 40 via line 64.

Delayed Coking

Referring now to FIG. 1, reduced-crude or vacuum-residue fresh coker feed is fed via line 112 into a preheater 85, where it is preheated by exchange against gas oil products before entering the coker-fractionator bottom surge zone. The fresh coker feed is mixed with recycle feed condensed in the bottom section of the fractionator 89 and is pumped through the heater 85, where the coker feed is rapidly heated to the desired temperature level for coke formation in the coke drums. Steam is often injected into each of the heater coils to maintain the required minimum velocity and residence time and to suppress the formation of coke in the heater tubes.

The delayed coking operation typically uses at least two drums 86, 87. One drum receives the furnace effluent, which it converts to coke and gas, while the coke in the other drum is being removed. The waste feed charge produced according to the process of the present invention is introduced into a drum during the feed cycle. In the preferred embodiment shown in FIG. 1, the waste feed charge in line 64 is fed into the top of one or the other of coke drums 86 and 87 during the coking cycle. The coke drum overhead vapor is recycled as desired via line 88 or returned to other parts of the refinery for re-use. It is preferred but not required that the waste feed charge in line 64 be fed into the top of the coke drum and not be mixed with the conventional coker feedstock. In an alternative embodiment, the waste feed charge is fed into line 91 leaving the heater. Some waste feed charges tend to clog the heating equipment, such as heater 85, but in some instances the nature of the sludge may be such that the clogging tendency is low enough to allow the sludge to be directly mixed with a coker feed either before or after the heater and then fed into the bottom.

Although the waste feed charge is shown being pumped directly from the dryer 40 and into one of the coker drums 86, 87, during the coking cycle, it should be appreciated that the waste feed charge may be transported, such as in tankers, to the coking facility.

Flexicoking

Figure 2:
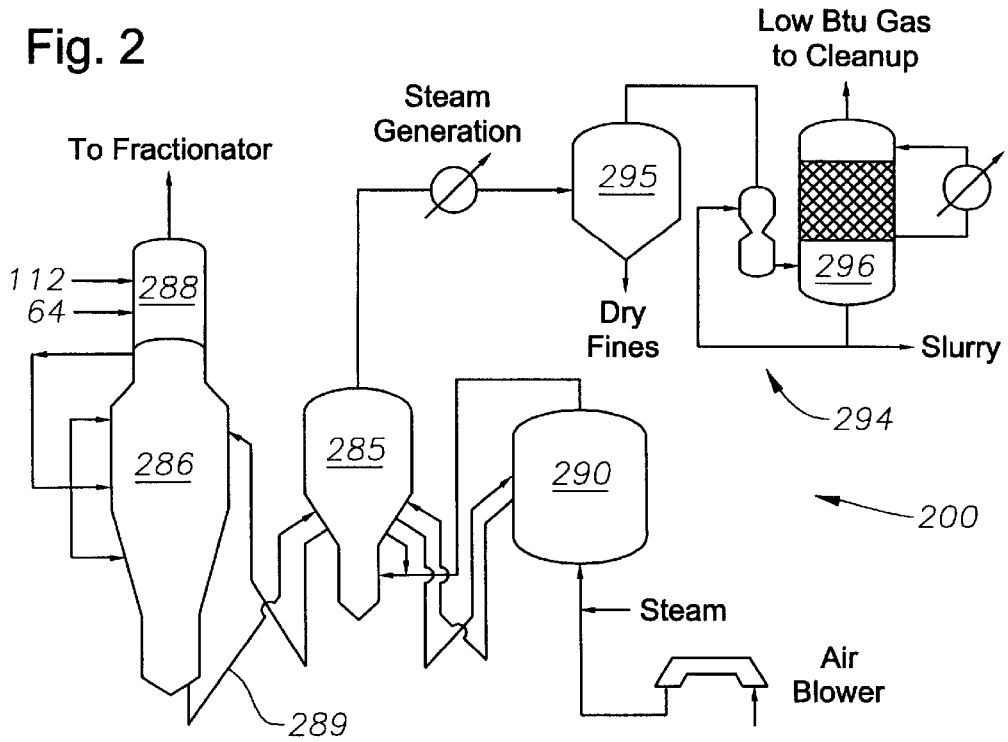
FIG. 2 is a schematic diagram of an alternative embodiment of a coking system in which the present invention can be applied.

Referring now to FIG. 2, in an alternative embodiment, the waste feed charge may be fed continuously into a flexicoker operation. The flexicoking system 200 comprises a fluid-bed reactor 286, a liquid product scrubber 288 on top of the reactor, a heater vessel 285, where circulating coke from the reactor is heated by gas and hot coke from the gasifier, a gasifier 290, a heater overhead gas cooling system 292, and a fines removal system 294.

Residuum feed at 500° to 700° F. is injected into the coker reactor 286 via feed line 112, where it is thermally cracked to a full range of vapor products and a coke product which is deposited on the fluidized coke particles. The sensible heat, heat of vaporization, and endothermic heat of cracking of the residuum is provided by a circulating stream or hot coke from the heater. Cracked vapor products are quenched in the scrubber tower (not shown). The heavier fractions are condensed in the scrubber 288 and, if desired, may be recycled back to the coking reactor 286. The lighter fractions proceed overhead from scrubber 288 into a conventional fractionator (not shown) where they are split into the desired cut ranges for further downstream processing.

Reactor coke is circulated to the heater vessel 285, where it is heated by coke and gas from the gasifier 290. A circulating coke feed stream is sent from the heater 285 to the gasifier 290, where it is reacted at an elevated temperature (1500 to 1800° F.) with air and steam to form a mixture of $H_2$, CO, $N_2O$, and $H_2S$, along with a small quantity of COS. The gasifier product gas, referred to as coke gas, plus entrained coke particles are returned to heater 285 and are cooled by cold coke from reactor 286 to provide a portion of the reactor heat requirement. A return stream of coke sent from gasifier 290 to heater 285 provides the remainder of the heat requirement.

The hot coke gas leaving heater 285 is used to generate high-pressure steam before passing through cyclones 295 for removal of entrained coke particles. The remaining coke fines are removed in a venturi scrubber 296. The solids-free coke gas is then sent to a gas cleanup unit (not shown) for removal of $H_2S$.

According to the present invention, the waste feed charge in line 64 is fed into scrubber 288 on heater 285, in parallel with the conventional coker feed stream 112. Alternatively, the waste feed charge can be fed directly into scrubber 288 or into line 289 leaving the bottom of the coker. Once in the system, the components of the present fuel composition are incorporated in the continuous flow of material through the flexicoker. It should be appreciated that the coker feed and waste feed charge may be mixed prior to flowing into the scrubber 288 such as by passing the coker feed and waste feed charge through a valve (not shown) at the inlet to the scrubber 288.

Fluid Coking

Figure 3:
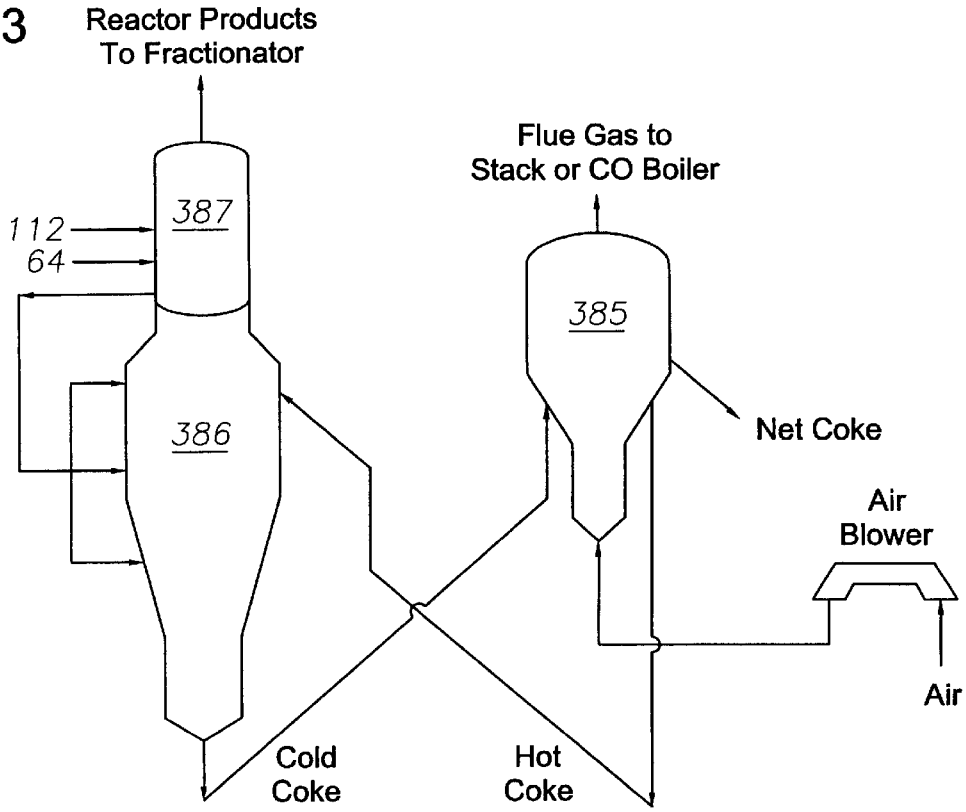
FIG. 3 is a schematic diagram of a second alternative embodiment of a coking system in which the present invention can be applied.

A simplified system for a fluid coking process is shown in FIG. 3. There are two major fluidized-bed vessels; a reactor 386 and a burner 385. The heavy hydrocarbon feed is introduced into a scrubber 387, where it exchanges heat with the reactor overhead effluent and condenses the heaviest fraction of the hydrocarbons. The total reactor feed, including both the fresh feed and the recycle condensed in the scrubber, is injected into a bed of fluidized coke in the reactor 386, where it is thermally cracked to produce lighter liquids, gas, and coke. The coke is laid down on the fluidized coke particles, while the hydrocarbon vapors pass overhead into scrubber 387. The reactor overhead is scrubbed for solids removal and the material boiling above 975° F. is condensed and recycled to reactor 386. The lighter hydrocarbons are sent from scrubber 387 to conventional fractionation, gas compression, and light ends recovery units.

Heat required to maintain reactor 386 at coking temperature is supplied by circulating coke between reactor 386 and burner 385. A portion of the coke produced in reactor 386 is burned with air to satisfy the process heat requirements. The excess coke is withdrawn from burner 385 and sent to storage.

According to the present invention, the waste feed charge in line 64 may be fed into scrubber 387, in parallel with the conventional coker feed stream 112. Once in the system, the components of the present fuel composition are incorporated in the continuous flow of material through the fluid coking system.

The Waste Stream

Without limiting the scope of the process of the present invention, the waste products typically found in refineries that can be treated to produce the waste feed charge include biological sludges from waste water treatment plants, such as activated sludges, and other oily sludges including gravity separator bottoms, storage tank bottoms, oil emulsion solids including slop oil emulsion solids, finely dispersed solids or dissolved air flotation (DAF) float from flocculation separating processes and other oily waste products from refinery operations.

As noted above, the composition of the present invention can be derived from refinery waste streams. Such streams can include, for example, API separator sludge, dissolved air floatation float, slop oil emulsion solids, tank bottoms (leaded) heat exchanger bundle cleaning sludge, oily waste sludges from the refinery's primary side of the waste water treatment system and oily tank bottom sludges. However, the source or feed stream for the composition need not be a waste stream from a refinery. For example, in numerous petrochemical and chemical operations, paint industry waste, waste streams, primarily aqueous in nature, are produced that pose the same or similar disposal problems in that they contain hazardous solids and nonaqueous liquids. Thus, the composition of the present invention can be derived from any waste stream that contains a liquid, nonaqueous fraction, a solids fraction and an aqueous fraction, regardless of source.

The waste products (streams) that are typically treated according to the process of the present invention are commonly referred to as sludges and are mixtures of water, organic compounds and solids. The sludges can vary widely in composition. The oily component, as noted above, can comprise a myriad of organic compounds ranging from hydrocarbons to other organic compounds. This mixture of organic compounds is commonly referred to as "oil" because, for the most part, it comprises combustible products (usually primarily hydrocarbons) that are or tend to be insoluble or immiscible in water.

The terms "oil" and "oily component" are intended to include materials that are organic in nature and are generally a mixture of water-insoluble organic compounds. Such organic components can include hydrocarbons, both aliphatic and aromatic, as well as other organic compounds containing oxygen, nitrogen and sulfur such as ketones, carboxylic acids, aldehydes, ethers, sulfides, amines, etc. Generally, especially in the case of waste products produced in the refining of petroleum, hydrocarbons are the principal components of the organic materials.

The solids in the waste products or streams comprise suspended carbonaceous matter together with varying quantities of non-combustible materials including silt, sand, rust, catalyst fines and other, generally inorganic materials. In general, the solids are those materials contained in the waste stream that are not soluble in either the water phase or the organic phase of the waste stream. Sludges of the type that are useful in the process of the present invention are typically produced in the course of various refining operations including thermal and catalytic cracking processes and from heat exchanger and storage tank cleaning and in the bottoms of various process units including API separators.

In a preferred process for producing the waste feed charge, a waste stream (sludge), as described above, is treated to produce a waste feed charge containing from about 30 to about 70 percent by weight solids; from about 30 to about 70 percent by weight oil, and less than about 5 percent by weight water. In a more preferred waste feed charge, the charge has less than 3% by weigh water with approximately equal amounts of solids and oil. A still more preferred waste feed charge contains substantially no water and contains equal amounts of oil and solids.

Similarly, because one objective of the present invention is the recycling of waste solids, one goal is to maximize the ratio of solids to oil in the coker feed stream. As a practical matter, however, there are disadvantages to introducing a solids stream that does not contain at least 30% liquid. Specifically, solid particles that are not wet when introduced into the coker may tend to get caught in drafts. Also, there is a risk that air could be introduced into the coker if the waste feed charge is not sufficiently fluid to fill the feed line. At present, it is expected that a feed stream containing approximately equal parts of solids and oil will be optimal.

For this reason, it is preferred to add oil back into the solids fraction. A minimum of about 30 percent by weight oil is needed to ensure that the stream is pumpable. Because optimum pumpability requires more than 30 percent oil, however, it is preferred that the fractions of oil and solids in the final stream be approximately equal. Thus, for example, in the most preferred stream, the water content would be virtually zero and the solids and oil would each comprise approximately 50 percent by weight of the stream. If the water content of the coker feed stream is 3 percent, the preferred oil content is 47 percent, with the balance of the composition comprising solids. The oil added to the solids stream is preferably oil obtained in the initial separation or oil that is generated downstream in the coking process, such as oils condensed from the coking vapors or oils produced in the blowdown process, although any oil stream can be used.

Because pumpability of the waste feed charge is affected by the particle size distribution of the solids fraction, treatment of the waste streams in accordance with the process of the present invention is preferably conducted so as to result in attrition of the solid particles such that the mean particle size is reduced to produce solids in the waste feed charge having a mean particle size of less than about 250 microns, and more preferably less than about 75 microns (200 mesh). In general, the solids in the waste stream should be treated by an attrition method such that greater than about 70 percent, and preferably greater than about 80 percent, of the total solids volume have a particle size less than about 250 microns. Preferably, the solids will have a particle size distribution that is generally, but not necessarily, Gaussian in nature. Such a distribution of the solids, coupled with maintaining the size of the solids in the above-specified particle size range, produces a coker feed stream that is less viscous and therefore more pumpable, and that produces a higher quality coke. In addition, when the waste feed charge is subject to settling, such as during transportation, smaller particles will tend to remain in suspension longer. It has been found that the vertical disk centrifuge described above not only separates the waste stream but also acts as attrition devices in the sense that the particle size of the solids is reduced and the desired distribution obtained. Moreover, the attrition mechanism is such that the particle size distribution tends to be Gaussian in nature.

The composition of the waste feed charge, because it has small particles and a relatively high content of liquids that are less polar than water, does not become viscous, rendering it unpumpable at ambient temperature. Prior art slurries used for fuel in furnaces or cement kilns suffer from the disadvantage that, because the water content is high, the solids content must be kept below about 25 percent-by-weight in order that the slurry can be handled by conventional pumps. As stated above, the fuel composition of the present invention contains a minimum of about 30 percent by weight solids and can contain about up to 70 percent-by-weight solids and still be pumpable. This high solids loading is further advantageous in that transportation and disposal costs per unit weight of solids is reduced.

Treating the waste stream to obtain the waste feed charge can be accomplished by numerous different methods, in addition to those described above. For example, the waste stream can be treated using a common horizontal decanter to separate out the a large portion of the water from the mobile organics and the solids, after which the solids are further treated in a suitable manner to obtain the desired water content, particle size and particle size distribution characteristics. Alternately, the waste stream can be separated using techniques such as filtration, decantation, extraction, etc., with the solids being subjected to size reduction by techniques such as ball mills, hammer mills, roller mills or any type of equipment in which grinding or disintegration of solids can be accomplished.

The coker feed compositions of the present invention can also include various other components, including dispersants and/or surfactants such as lignosulfonates. There is no heat value requirement for the waste feed charge however because of its oil content, the waste feed charge will tend to have a heat capacity of at least about 5,000 BTUs per pound, and more typically at least about 10,000 BTUs per pound.

Because the present waste-derived coker feed stream is virtually water-free, the rate at which it can be fed in to the coking process is limited by the desired ash content of the coke output, rather than by the amount of water than can be introduced into the coker. Typical coke specifications set an upper limit of 0.1 percent on ash content. In the coking process, one ton of solids produces 0.7 tons of ash, so the rate of feed of the waste-derived feed stream into the coker can be calculated for each operation.

While various preferred embodiments of the invention have been shown and described, modifications thereof can be made by one skilled in the art without departing from the spirit and teachings of the invention. The embodiments described herein are exemplary only, and are not limiting. Many variations and modifications of the invention and apparatus disclosed herein are possible and are within the scope of the invention. Accordingly, the scope of protection is not limited by the description set out above, but is only limited by the claims that follow, that scope including all equivalents of the subject matter of the claims.

What is claimed is:

1. A method for recycling a waste stream containing water and solids, comprising:

(a) removing water from the waste stream to produce a second stream containing less than 60% by weight water;

(b) drying the second stream to produce a waste feed charge containing less than 15% by weight water and at least 30% by weight solids; and (c) injecting the waste feed charge into a coker during the coking cycle.

2. The method of claim 1 wherein the second stream is further dried to produce a waste feed charge containing less than 3% by weight water.

3. The method of claim 1, further including mixing sufficient oil into the waste feed charge to render the waste feed charge pumpable.

4. The method of claim 1 wherein the solids and oil are in approximately equal proportions in the waste feed charge.

5. The method of claim 1, further including emulsifying the second stream.

6. The method of claim 1, further including reducing the average particle size of the solids to less than 250 microns prior to step (c).

7. A method for recycling solid components of a waste stream, comprising:

(a) separating the solids from the waste stream to produce a solids charge;

(b) adding oil to the solids charge in an amount 0.5 and 1.5 times the weight of the solids;

(c) reducing the water content of the solids to less than 15 percent by weight of the total solids charge to produce a pumpable waste feed charge containing at least 30% by weight solids; and (d) injecting the pumpable waste feed charge into a coker.

8. The method of claim 7, wherein step (d) takes place during the coking cycle.

9. The method of claim 7 wherein the pumpable feed charge is fed into the top of a coker during the coking cycle.

10. The method of claim 7 wherein the water content of the pumpable waste feed charge is less than 3 percent by weight.

11. The method of claim 7, further including the step of mixing the waste feed charge with fresh coker feedstock and injecting the mixture into a coker during coking.

12. The method of claim 7 wherein the oil added in step (b) comes from the waste stream.

13. A method for recycling components of a waste stream containing a liquid organic component, water and solids comprising:

(a) separating said waste stream into a liquid organic fraction, a water fraction, and a solids fraction containing less than about 60% by weight water in a first dewatering step;

(b) admixing oil with said solids fraction to produce a feed charge;

(c) heating said feed charge so as to evaporate water and produce a pumpable waste feed charge comprising less than about 15% by weight water, greater than about 30% by weight solids, and from about 30 to about 70% by weight oil; and (d) injecting said waste feed charge as a feed stream into a coker during a coking operation.

14. The method of claim 13 wherein said waste feed charge comprises less than about 5% by weight water.

15. The method of claim 13 wherein said waste feed charge comprises less than about 3% by weight water.

16. The method of claim 13, further including a second de-watering step between steps (a) and (b).

17. The method of claim 13 wherein said waste feed charge comprises at least about 50% by weight solids.

18. The method of claim 13 wherein said waste feed charge comprises approximately 70% by weight solids.

19. The method of claim 13 wherein said waste feed charge comprises about 3 percent by weight water, about 50 percent by weight solids and about 47 percent by weight oil.

20. The method of claim 13 wherein said solids and said oil components are present in said waste feed charge in approximately equal proportions.

21. The method of claim 13 wherein step (a) is carried out using a vertical disk centrifuge.

22. The method of claim 13 wherein step (a) is carried out using a decanter.

23. The method of claim 13 wherein the coker in step (d) is a delayed coker.

24. The method of claim 13 wherein the coker in step (d) is a flexicoker.

25. The method of claim 13 wherein the coker in step (d) is a fluid coker.

26. The method of claim 13 wherein step (d) comprises adding said waste feed charge to the top of a coker.

27. The method of claim 13, further including the step of mixing the waste feed charge with fresh coker feed and injecting the mixture into a coker.

28. The method of claim 13 wherein said solids have a mean particle size less than 250 microns.

29. The method of claim 13 wherein said solids have a mean particle size less than 75 microns.

30. The method of claim 13 wherein the oil added in step (b) comes from the waste stream.

31. The method of claim 13 further including reducing the size of the particulates making up the solids.

32. The method of claim 7, further including the step of mixing emulsifying the pumpable waste feed charge.

33. The method of claim 13, further including the step of mixing emulsifying the pumpable waste feed charge.

* * * * *